United States Patent [19]

Hardin

[11] 4,126,974

[45] Nov. 28, 1978

[54] EXPANDABLE BEAM STRUCTURE

[76] Inventor: Gary L. Hardin, 4636 York Ave., S. Minneapolis, Minn. 55410

[21] Appl. No.: 852,491

[22] Filed: Nov. 17, 1977

[51] Int. Cl.[2] ..... E04H 12/18

[52] U.S. Cl. ..... 52/109; 74/521; 182/69; 182/141

[58] Field of Search ..... 52/109; 14/45; 74/521; 182/69, 141

[56] References Cited

U.S. PATENT DOCUMENTS

| | | | |
|---|---|---|---|
| 217,439 | 7/1879 | Zimmerman | 182/51 |
| 430,935 | 6/1890 | Edwards | 52/109 X |
| 1,095,391 | 5/1914 | Fogle | 182/69 X |
| 1,511,679 | 10/1924 | Schwarz | 52/109 |
| 2,625,443 | 1/1953 | Sensenbaugh | 182/141 |
| 2,697,845 | 12/1954 | Broner | 52/109 X |
| 3,053,351 | 9/1962 | Fulcher | 52/109 |

*Primary Examiner*—Alfred C. Perham
*Attorney, Agent, or Firm*—Schroeder, Siegfried, Ryan, Vidas & Steffey

[57] ABSTRACT

The invention relates to an expandable beam structure comprising a plural-sided structure, each side formed of consecutive pairs of scissor links pivotally connected end-to-end to form a side. The plural-sided figure is connected by intermediate sides and the main sides are interconnected through pivot members which pivot the ends of the links and interconnect the sides. The pivot members combined to form a locking device to maintain the beam in an erected position and further support a tensioning means whenever it is desired to tension the beam.

9 Claims, 4 Drawing Figures

EXPANDABLE BEAM STRUCTURE

FIELD AND BACKGROUND OF INVENTION

This invention relates to an exapandable beam structure formed of a plurality of sides of scissor link members which may be readily extended to erect a beam from a collapsed position for usage.

In the past, there have been many applications of scissor link type structures applied to booms, towers, and supports of varying types. A continuous need for structures of this type, which can be retracted to a very compact configuration for transport and storage and expanded for use, has existed for a long time. Numerous examples of prior patented structures of this general type exist in the prior art. Some typical prior structures, for example, are shown in the following U.S. Pat. Nos. 156,842, 217,439; 1,511,679; 1,947,647; and 3,435,570. All of these prior structures have a point in common in that they have relatively low strength in the extended direction. As such they are not capable of withstanding high load conditions. Further, some of these structures have been made expandable through the use of very complicated extension means, such as centrally located telescopic booms or screw or guide structures to expand the same. The interconnection between the links in such prior structures provide the capability of the extension but fail to provide a structure with any tensile or compressive strength or any means for increasing the strength of the same.

SUMMARY OF PRESENT INVENTION

The present invention is directed to an improved beam structure which collapses to a very small compact unit to require a minimum of storage space. The compact size permits ease in handling and transportation of the same. The unit extends to a significant length so that it may be used as a tower or horizontally as a beam for a support. The application of such a structure is readily found in the need for towers in remote locations where it is not possible to transport even sections of a tower for final assembly because of difficulties in traversing rough terrain. Further, the structure has application as a beam in that it may be elongated and positioned horizontally or cantilever style to provide a frame support for temporary bridge structures or the like. The improved beam structure is a plural-sided structure having a plurality of main sides and a plurality of interconnecting sides, each of the sides being formed of a pair of scissor links connected end-to-end to provide the extent of the same. Block members interconnect the links of the main and intermediate sides, and in the extended position, the connecting side links move to an over center position such that they are substantially aligned to provide corners of the polygonal beam structure which is basically formed of the main sides. The intermediate links are of short length than the links of the main sections and the pivot means connecting the links at the corners are the block members which nest together in the expanded position. The block members include means for securing the block members together to maintain the beam in the extended position. In addition, the blocks have apertures therein which are aligned so that in the extended position, a tensioning rod or cable may be extended through the beam and secured to the ends of the same to apply tension to the beam to increase the strength of the same. The link sections pivot to expand and contract as a unit and the beam structure may be erected from a collapsed to an extended position either in a horizontal or a vertical position through an external pulling force means. When the beam structure is extended, it is locked in position and the tension means may be applied thereto to increase the strength of the same. It provides an extremely long or high beam which may be used as a tower or as a bridge support or equivalent structure and yet, in a collapsed position, may be readily transported to a place of usage.

IN THE DRAWINGS

DESCRIPTION OF PREFERRED EMBODIMENT

Figure 2:
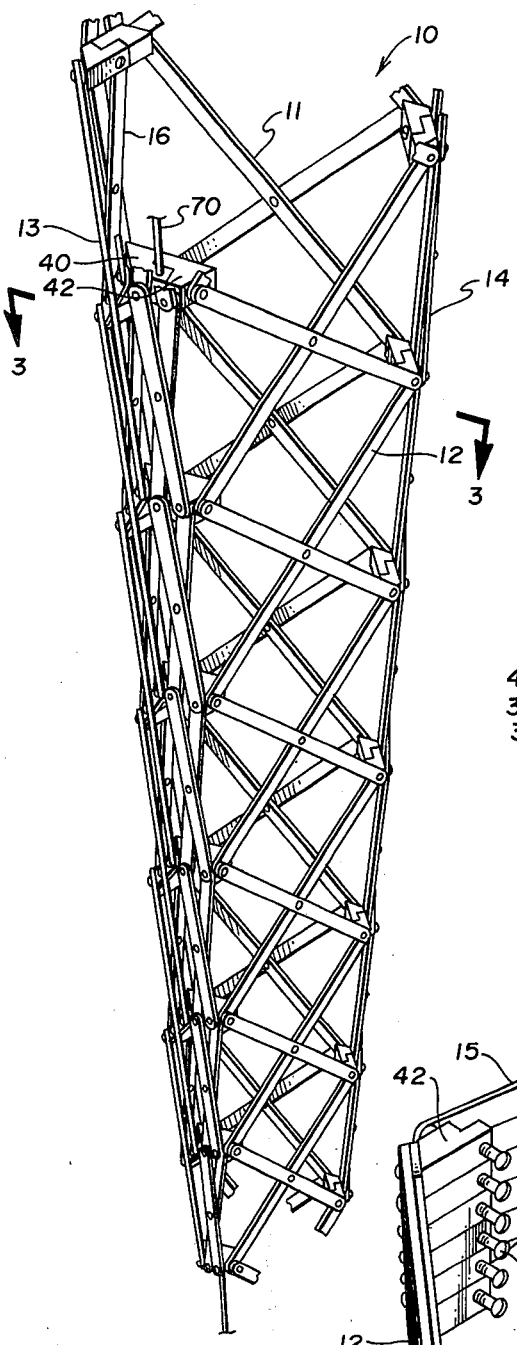
FIG. 2 is a perspective view of the expandable beam structure in an extended position with parts broken away.
Figure 4:
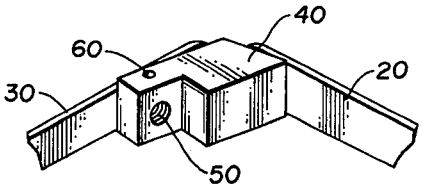
Figure 1:
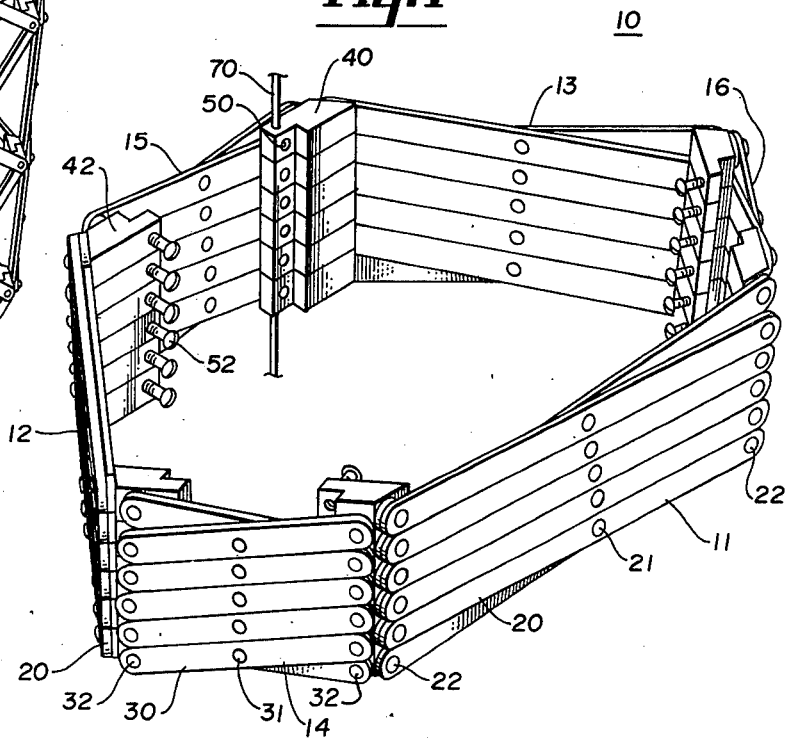
FIG. 1 is a perspective view of the expandable beam structure in collapsed position.

My improved beam structure is shown in perspective in a collapsed and extended position in FIGS. 1 and 2, generally at 10. In the erected position, the beam structure is a generally three-sided figure and in the collapsed position, the main three sides indicated at 11, 12, and 13 have positioned therebetween intermediate sides numbered 14, 15 and 16. In the collapsed position on the beam structure when the individual links (to be later identified) are in a generally horizontal position, the general width of the sides 11, 12, and 13 correspond with the length of the main links. Similarly, the width of the intermediate sides 14, 15 and 16 correspond to the length of the links forming the intermediate sides. In the extended position, the links forming the intermediate sides of the beam structure pivot to a position in which they are substantially vertical and the width of the sides are substantially reduced to give a generally three-sided configuration to the beam. As will be seen in FIGS. 1 and 2, the main sides of the beams are formed by scissor links 20 which are pivotally connected to a midpoint and connected end-to-end to similar pairs of links extending throughout the sides of the beam. These links are flat metal plates of a given dimension and the pivots such as are indicated at 21 and 22 at the center and ends respectively of the link are formed by suitable nuts and bolts or rivets to allow the links to pivot. The links on the intermediate sides are identified at 30 and have a length dimension which is slightly greater than half the links 20 forming the main sides or generally at the ratio of 1:2. They are similarly pivoted through pivot means 31 at the midpoints and pivots 32 at the extremities to one another to allow the links to pivot in the conventional scissor link fashion. The intermediate sides 14, 15 and 16 are connected to the main sides 11, 12 and 13 by block members 40, 42 at the pivot points 22, 32.

Figure 3:
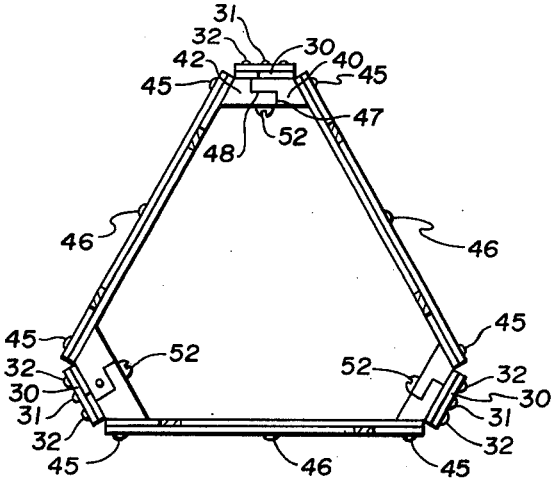
FIG. 3 is a sectional view of a portion of the beam structure taken along the lines 3—3 in FIG. 2; and, FIG. 4 is a fragmentary perspective view of the portion of the beam structure showing the aperture for the tensioning means.

As will be best seen in FIG. 3, the block members 40, 42 have flat and beveled sides such that the links 20 and 30 may pivot along the side and a suitable bolt means 45, 46 are fitted into tapped apertures in the block and provide pivot surfaces to define the pivots 32, 22 for the ends of the links and to interconnect the sides. The block 40 has a recess surface 47 therein and a complimentary recess surface 48 is provided in the block 42 such that the blocks may be brought together and overlap in the expanded position of the beam structure. A suitable aperture 50 is provided in the blocks 40, 42 in the recessed portion so that a threaded bolt 52 may be positioned therethrough and secure the blocks in abutting relationship and maintain the links in an expanded position.

As will be best seen in FIG. 3, for the expanded position of the beam structure, the blocks 40, 42 fit together and the surfaces of the intermediate sides formed of the links 30, which are pivoted to their substantially vertical position, provide a flat surface for the beam structure or an intermediate side surface which is determined by the width of the blocks. To secure the beam in an extended position, the bolt means 52 extends through each of the apertures 50 in the blocks 40, 42 to lock the blocks in an abutting position. In addition, a second aperture 60 is aligned through the blocks and this aperture, for each of the blocks forming a corner of the beam, will be aligned such that a suitable tensioning cable, such as is indicated at 70, may be placed therethrough. The cable may be anchored at one end and suitable tensioning means provided to tension the cable when the beam is in an expanded position to prestress the cable. This may provide a slight cantilever shape to the beam and will provide additional supporting force and tension at the particular corner in which the tensioning cable is positioned. The improved beam structure, for example, may be made of main links having a length of substantially 18 inches between pivot extremities with the intermediate links 30 having a length of approximately 10½ inches between extremities. For such a beam the links may have a width of approximately ⅞ inch and a thickness of approximately ¼ inch. A resultant beam structure in the extended position will provide a beam of approximately 14 inches to 15 inches on a side. The ratio of length between the collapsed and extended position for such a beam is in the ratio of 1:12 such that a 5 foot collapsed beam will produce an extended 60 foot beam. In a collapsed position, such a beam is readily transportable to a place of usage and may be extended to auxiliary means to elongate the same. After the blocks are secured, a tensioning cable may be connected to the beam to provide a generally superior and longer beam structure than is heretofore possible from a collapsed structure. When using the beam as a tower, one end of the beam would be securely anchored to an anchoring base and the beam structure elevated through suitable means, such as a lifting force of a helicopter, until the beam is completely extended. At that point, the corners may be locked and suitable guy wires attached to provide a supported tower having all the strength and load capacity of a conventional tower. The improved beam structure may be used not only as a temporary beam and tower but as a permanent building element where it is desired to have a structure readily transportable to a building site and yet extensible to a desired structure length with sufficient strength to support building structure.

While I have shown the preferred embodiment as a three-sided figure, it will be recognized that the beam or platform may be formed of a plural number of sides having the same number of main sides as intermediate sides with interconnections in the manner described above. Therefore, in considering this invention, it should be remembered that this disclosure is illustrative only and the scope of the invention should be determined by the appended claims.

What is claimed is:

1. An expandable beam structure comprising, a three-sided beam structure with each side being formed of pairs of scissor links each having a given length dimension and pivotally connected end-to-end to form the side, connecting side surface means formed intermediate each side of said beam structure, said connecting side surface means each being formed of a plurality of pairs of scissor links pivotally connected end-to-end with the links having a shorter length dimension than the links forming the three sides of the beam structure, block means pivotally connecting the ends of the links of the main sides with the links of the side surface means and means included in part in said last named means for maintaining said beam structure in an expanded position, said links forming the sides and the connecting side surface means of the beam structure being constructed to form a six-sided structure in a collapsed position, said means included in part in said last named means being notches in the respective blocks permitting the blocks to fit together and apertures through the blocks to permit pins to be threaded therethrough to hold the blocks together and hence the beam structure in an expanded position.

2. The expandable beam structure of claim 1 in which the shorter links are in the ratio of 2:3 to the longer links forming the sides of the beam structure.

3. The expandable beam structure of claim 2 in which the blocks have additional apertures therethrough which align with one another when the blocks are brought together to permit the passage of tensioning means therethrough.

4. The expandable beam structure comprising, a plural-sided structure including a plurality of main sides and an equal number of intermediate connecting sides positioned between the main sides, each of the sides of the structure being formed of a plurality of pairs of scissors links connected end-to-end, the links of the main sides having a length dimension which is greater than the length of the links forming the intermediate sides, pivotal connection means positioned at the ends of each pair of links and pivotally connecting the ends of the links of the main sides to the ends of the links of the intermediate sides, and means securing the pivotal connection means in abutting contact when the beam structure is in the expanded condition.

5. The expandable beam structure of claim 4 in which the number of main sides are three.

6. The expandable beam structure of claim 5 in which the scissor links forming the intermediate sides are substantially aligned in the expanded position of the beam structure.

7. The expandable beam structure of claim 6 in which the scissor links forming the main and intermediate sides are made of metal.

8. The expandable beam structure of claim 7 in which the pivotal connection means connecting the adjacent links of the intermediate and main sides are block means.

9. The expandable beam structure of claim 8 and including means for applying the tension to the beam structure in the expanded positon including tension means passing through the blocks and secured to the blocks at the end of the beam structure.

* * * * *